United States Patent [19]

Hectors et al.

[11] 4,286,037

[45] Aug. 25, 1981

[54] ELECTROSTATIC IMAGE ONE-COMPONENT ELECTRICALLY CONDUCTIVE THERMOPLASTIC RESIN CONTAINING POWDERED DEVELOPER PREPARED BY COAGULATION IN EMULSION

[75] Inventors: Adrianus M. P. Hectors, Tegelen; Gerardus J. Crommentuyn, Lottum, both of Netherlands

[73] Assignee: Oce-van der Grinten N.V., Venlo, Netherlands

[21] Appl. No.: 939,852

[22] Filed: Sep. 5, 1978

Related U.S. Application Data

[62] Division of Ser. No. 757,629, Jan. 7, 1977, Pat. No. 4,146,494.

[30] Foreign Application Priority Data

Jan. 23, 1976 [NL] Netherlands ..... 7600686

[51] Int. Cl.[3] ..... G03G 9/08

[52] U.S. Cl. ..... 430/107; 430/110; 430/137; 430/903; 260/42.53; 260/42.54; 260/DIG. 20; 252/316

[58] Field of Search ..... 252/62.1, 316, 315; 260/42.54, 42.53, DIG. 20; 430/137, 107, 110, 903

[56] References Cited

U.S. PATENT DOCUMENTS

| | | | |
|---|---|---|---|
| 2,925,397 | 2/1960 | Hopfner et al. | 260/42.57 |
| 3,070,600 | 12/1962 | Rudner | 260/DIG. 20 |
| 3,093,039 | 6/1963 | Rheinfrank | 252/62.1 |
| 3,234,017 | 2/1966 | Heyl et al. | 430/107 |
| 3,427,258 | 2/1969 | Trease | 430/107 |
| 3,586,654 | 6/1971 | Lerman et al. | 430/137 |
| 3,745,118 | 7/1973 | Brynko | 430/137 |
| 3,893,935 | 7/1975 | Jadwin | 252/62.1 |

*Primary Examiner*—John D. Welsh
*Attorney, Agent, or Firm*—Albert C. Johnston

[57] ABSTRACT

Electrically conductive developer powder for developing electrostatic images by inductive attraction is provided, with avoidance of practical disadvantages of known "one-component" developer powders, by incorporating finely divided water-insoluble quaternary ammonium salt into thermoplastic resin particles forming the powder, with or without other finely divided additives such as coloring material and/or magnetically attractable material. The specific resistance of the resin particles is lowered to between $10^7$ and $10^{11}$ ohm. cm by from 8 to 35% by weight of the quaternary ammonium salt, and can be lowered further by additions of fine conductive material such as carbon black. The resin particles remain sufficiently fusible even when they also contain enough magnetically attractable material, e.g. about 50% by weight, to render them transportable by a magnetic powder-applicator. A further important feature of the invention consists in preparing thermoplastic resin particles of suitable size with the quaternary ammonium salt already finely dispersed in them simply by coagulating an aqueous resin emulsion that contains one of the ions required for forming said salt, in a coagulant liquid containing the other of said ions. When so desired, the other additives can also be finely dispersed in these resin particles via the coagulant liquid.

19 Claims, No Drawings

ELECTROSTATIC IMAGE ONE-COMPONENT ELECTRICALLY CONDUCTIVE THERMOPLASTIC RESIN CONTAINING POWDERED DEVELOPER PREPARED BY COAGULATION IN EMULSION

This is a division of copending application Ser. No. 757,629, filed Jan. 7, 1977, now U.S. Pat. No. 4,146,494.

This invention relates to a one-component developer powder for developing electrostatic images, which powder has so high an electrical conductivity that it can be deposited by inductive attraction onto an electrostatic image. The invention relates also to a process for preparing the one-component developer powder.

Several types of one-component developer powders of the kind mentioned are known.

Such powders as described in U.S. Pat. No. 3,196,032 and Dutch patent application 7203523 comprise particles composed of a core of resin that may or may not contain finely divided magnetically attractable material and that has fine carbon particles deposited on its surface. These developer powders often have the disadvantage that the carbon particles are insufficiently anchored on the resin core and become released from the resin surface under the mechanical influences to which the developer powders are continually subjected in electrostatic copying apparatus, thus causing serious pollution of the copying apparatus. When these developer powders are used in so-called indirect electrophotographic copying apparatus, the loosened fine carbon particles may adhere onto the photoconductive intermediate medium, thus considerably shortening the working life-time of this medium.

The preparation of the resin particles covered with carbon particles also presents problems. Since the methods of preparing them are based on making the resin cores sticky and depositing carbon particles onto the sticky resin surfaces, the preparing conditions used must be controlled carefully in order to prevent agglomeration of the resin cores. Moreover, while U.S. Pat. No. 3,196,032 describes preparation of the developer powders in a fluidized bed with use of an organic solvent which softens and tackifies the surface of the resin cores, this method requires a complex equipment as well as installations for recovering the solvent or burning it completely.

U.S. Pat. No. 3,166,510 describes an inductively attractable one-component developer powder which comprises thermoplastic resin particles having at least 35% by weight of carbon dispersed in them in order to give the desired electrical conductivity. Since these particles must already have a high solids content in order to possess the desired electrical conductivity, they can hardly be made suitable for application by the known magnetic brush developing methods which are usually the preferred way of applying them. To make the powders suited for use in magnetic brush developing methods a considerable amount, typically approximately 50% by weight, of magnetically attractable material must additionaly be incorporated in the resin particles. As a result, the entire solids content of the particles becomes so high that their fusing properties are insufficient.

Inductively attractable one-component developer powders are also known, from British patent specification No. 940,577, which comprise thermoplastic resin particles having deposited on their surface water-soluble antistatic agents, such as quaternary ammonium chlorides, alkyl sulphonates, phosphoric esters, polymethacrylic acid or derivates of polymethylene oxide. These developer powders have the drawback that their electrical conductivity depends greatly upon the moisture content of the conductive covering, as a result of which varying results are obtained with these powders. Their electrical conductivity is usually insufficient under the rather dry conditions that may prevail in copying apparatus kept in operation for some time. Moreover, these developer powders have the disadvantage that the antistatic agent is sticky, especially if it contains the amount of moisture required for obtaining a proper electrical conductivity, as a result of which the flow properties of the powder leave much to be desired.

The present invention provides an improved one-component developer powder that can be deposited by inductive attraction onto an electrostatic image and that does not show, or at least appreciably avoids, the disadvantages mentioned above. The invention also provides a process for preparing the improved developer powder.

According to the invention, a one-component developer powder that can be deposited by inductive attraction onto an electrostatic image is provided as a powder of thermoplastic resin particles which contain a finely divided, substantially water-insoluble quaternary ammonium salt that is soluble to an extent of less than 3% by weight in water at 25° C. These resin particles may also contain additives such as coloring material and/or magnetically attractable material.

The individual particles of the one-component developer powder according to the invention bear no electrically conductive covering that might be rubbed off by mechanical influences; so the copying properties of the developer powder remain nearly unchanged even during prolonged copying, and pollution of the copying apparatus due to fine abrasive powder is avoided. The flow properties of this developer powder are superior to those of identically or almost identically formed powders having a covering of a water-soluble antistatic agent. Also, as compared with the latter powders, the conductive properties depend to a markedly less degree on the moisture content, and always sufficient under the conditions of practical use of the developer powders.

The quantity of water-insoluble quaternary ammonium salt present in the resin particles should be high enough to render the developer powder relatively electrical conductive, so that it can be deposited by inductive attraction into an electrostatic image. The specific resistance to be possessed by the developer powder for a given manner of use depends upon the use conditions, particularly the method of bringing the powder into contact with the electrostatic image to be developed, the composition and electrical properties of the material carrying the electrostatic image and the development time. Generally, the specific resistance of the one-component developer powder must be lower than $10^{13}$ ohm.cm, and for most uses the developer powders are provided with a specific resistance of between approximately $10^5$ and $10^{11}$ ohm.cm.

One-component developer powders having a specific resistance of between $10^7$ and $10^{11}$ ohm.cm are obtained according to the invention by incorporating 8 to 35% by weight of the specified water-insoluble quaternary ammonium salt in the thermoplastic resin particles. To obtain the developer powders with a specific resistance of between $10^5$ and $10^7$ ohm.cm, from 10 to 15% by weight of a suitably conductive pigment, such as carbon black or very fine iron or copper powder, is finely dispersed in the resin particles in addition to the water-insoluble quaternary ammonium salt.

It has been found possible, according to the invention, to use percentages of conductive pigment up to 15% by weight in developer powders already containing 50% by weight of magnetically attractable pigment, without reducing the fusing properties of the developer powder to an unacceptable level. However, the fusing properties of the powders will be insufficient if, in addition to 50% by weight of magnetically attractable pigment, more than 15% by weight of a suitably conductive pigment is used, as is necessary with those of the above-mentioned known developer powders which do not contain a water-soluble antistatic surface covering agent for obtaining the desired electrical conductivity.

The quaternary ammonium salts useful according to the invention have a solubility of less than 3%, and preferably less than 1%, by weight in water at 25° C. Choices may be made from a wide variety of such water-insoluble quaternary ammonium salts. Especially suitable quaternary ammonium salts are the salts of polymeric quaternary ammonium bases having less than 3% by weight water-solubility. The quaternary ammonium group of these polymers may be linked directly or indirectly to the polymeric chain, or may form part of this chain. Examples of such polymeric quaternary ammonium bases are: quaternized polyalkylene imines, for instance quaternized polyethyleneimine; polymers containing a quaternized heterocyclic nitrogen ring in their chain, for instance the condensation products of dihalo alkanes with quaternized pyrazine, piperazine or a dipyridyl alkane, such as the condensation product of 1,3-di-4-pyridylpropane with 1,2-dichloroethane; polyolefins having quaternary ammonium groups linked directly or indirectly to the polymeric chain, such as polyvinyl trimethylammonium hydroxide, poly-(N-methylvinylpyridinium hydroxide) and polyalkyltrimethylammonium hydroxide; polystyrenes of which the phenyl group has been substituted directly or indirectly by a quaternary ammonium group, such as polyvinyl benzyl trimethylammonium base; polyacrylic esters or polyacrylic amides of which the ester or amide group carries a quaternary ammonium group, such as poly(3-trimethylammonium) propyl methacrylate and poly(N-3-trimethylammonium propyl) acrylic amide; and polymerisation products of dialkylammonium hydroxides as described in U.S. Pat. No. 3,288,770.

The water-insoluble salts of non-polymeric quaternary ammonium bases can also be employed in the one-component developer powders according to the invention. Particularly effective among these are the water-insoluble salts of quaternary ammonium bases satisfying the general formula:

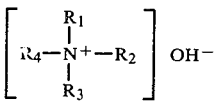

in which $R_1$, $R_2$, $R_3$ and $R_4$ represent aliphatic or aromatic hydrocarbon groups having together at least 12 carbon atoms. Examples of such quaternary ammonium bases are: decyltrimethylammonium hydroxide, hexadecylbenzyldimethylammonium hydroxide, benzylphenyldimethylammonium hydroxide, hexadecyltrimethylammonium hydroxide, benzylstearyldimethylammonium chloride, distearyl dimethylammonium chloride and didecyldimethylammonium chloride.

Other suitable quaternary ammonium bases include quaternized heterocyclic nitrogen bases of which the nitrogen atom may or may not be substituted by one or two hydrocarbon groups (e.g. alkyl groups), such as cetylpyridinium chydroxide.

Preferably, the anion of the water-insoluble quaternary ammonium salts is derived from a carboxylic or sulphonic acid having at least 6 carbon atoms. Examples of such acids are: caproic acid, heptoic acid, pelargonic acid, capric acid, lauric acid, myristic acid, palmitic acid, stearic acid, oleic acid, azelaic acid, sebacic acid, p-toluene sulphonic acid, lauryl hydrogensulphate, decyl hydrogensulphate and dodecyl hydrogensulphate. The anion may also be derived from polymeric organic acids, especially if the quaternary ammonium base is a non-polymeric compound. Examples of polymeric acids are: polyacrylic acid, carboxymethyl cellulose, alginic acid, and copolymers of vinyl compounds with $\alpha,\beta$-unsaturated carboxylic acids.

The thermoplastic resin in the developer powder particles according to the invention may be any of the resins known for the preparation of developer powders, which resins have a softening point of between 50° and 130° C., but preferably between 65° and 115° C. Examples of such resins include polystyrene, copolymers of styrene with an acrylate or methacrylate, copolymers of styrene with butadiene and/or acrylonitrile, polyacrylates and polymethacrylates, copolymers of an acrylate or methacrylate with vinyl chloride or vinyl acetate, polyvinyl chloride, copolymers of vinyl chloride with vinylidene chloride, copolymers of vinyl chloride with vinyl acetate, polyester resins, epoxy resins and polyamides.

In addition to thermoplastic resin and water-insoluble quaternary ammonium salt, the developer powder particles according to the invention may contain the well-known additives in quantities known for such additives, such as coloring material and magnetically attractable material. The coloring material may be an organic dye or an inorganic pigment, such as carbon black, red lead or chrome yellow. Generally, the amount of coloring material present in the powder particles does not exceed approximately 15% by weight. The magnetically attractable material may be, for instance, very finely divided iron, nickel, chromium oxide, iron oxide, or ferrite of the general formula $MFe_2O_4$, in which formula M is a bivalent metal such as iron, cobalt, zinc, nickel or manganese.

The water-insoluble quaternary ammonium salts used according to the invention are not readily miscible with a melt of the theromplastic resins frequently employed in developer powders. Consequently, a fine distribution of quaternary ammonium salt in a thermoplastic resin melt is often not obtained by mixing them together, or is obtained only after prolonged and very intensive mixing. The preparing method employing a resin solution requires the use of organic solvents exclusively and, therefore, it is not very attractive for practical use.

According to a further feature of the present invention, a simple process is provided for accomplishing a fine distribution of water-insoluble quaternary ammonium salt in thermoplastic resin. In this process, an aqueous emulsion containing very fine thermoplastic resin particles and one of the ions required for forming a water-insoluble quaternary ammonium salt is coagulated in a coagulant containing the other ion required for forming the water-insoluble quaternary ammonium salt. It has been found that, in this way, the water-insoluble quaternary ammonium salt is formed during coagulation of the resin emulsion, and the salt so formed proves to be incorporated almost quantitatively and in a finely divided state in the coagulated resin particles. The one-component developer powder is then obtained by separating from the coagulant mixture and drying the finely divided coagulated resin particles containing water-insoluble quaternary ammonium salt, after which these particles, if so required, are sieved or ground and sieved in order to obtain the desired particle size. When the developer powder still has to contain additives, such as magnetically attractable material and/or coloring material, these additives can be incorporated by melting the resin particles after they have been separated from the coagulant, finely dispersing the additives in the resin melt, cooling down the melt to a solid mass, and grinding the solid mass to particles of the desired particle size.

In addition to fine thermoplastic resin particles the resin emulsion employed in the process according to the invention contains one of the ions required for forming a water-insoluble quaternary ammonium salt. This ion may be the cation, i.e., the quaternary ammonium ion, or the anion.

The resin emulsion can be prepared by the use of conventional emulsion-polymerisation techniques, in which one or more polymerizable monomers are emulsified in water with the aid of an emulsifier and subsequently the polymerisation of the monomer or monomers is initiated in an oxygen-free atmosphere, for instance under nitrogen, by addition of a polymerisation initiator, for instance potassium persulphate or a peroxide such as benzoyl peroxide. The emulsifier used for this emulsion-polymerisation can serve also, at the same time, as the substance providing the first ion required for forming the water-insoluble quaternary ammonium salt. Accordingly, one or more water-soluble quaternary ammonium salts, for instance the halides (e.g., chlorides) of the quaternary ammonium bases of the above general formula, or one or more water-soluble salts of organic acids having a hydrophobic hydrocarbon group, are used as emulsifier. Examples of the suitable emulsifiers include: decyltrimethylammonium chloride, dodecyltrimethylammonium chloride, hexadecyltrimethylammonium chloride, hexadecyl-benzyldimethylammonium chloride, benzyl-phenyldimethylammonium chloride, potassium laurate, potassium myristate, sodium oleate, sodium stearate, potassium palmitate, sodium decylsulphonate, sodium dodecylsulphonate, sodium laurylsulphate and sodium dodecylsulphate. The use of these emulsifiers in emulsion-polymerisations is known by itself.

Examples of emulsion-polymerizable monomers suitable for the process according to the invention include: styrene, methyl styrene, butadiene, acrylonitrile, methacrylonitrile, vinyl acetate, vinyl chloride, vinylidene chloride, esters of acrylic and methacrylic acid such as methyl acrylate, butyl acrylate, methyl methacrylate, ethyl methacrylate, isobutyl methacrylate, acrylic amides and methacrylic amides such as N,N-dimethyl acrylic amide and N-methyl methacrylic amide. Further, as is well known, a chain transfer agent may be incorporated in the polymerization mixture, in order to control the length of the polymer chains formed in the emulsion-polymerisation process. Alkyl mercaptans having 4 to 16 carbon atoms, for example dodecyl mercaptan, are particularly suitable chain transfer agents.

The resin emulsion as obtained by emulsion-polymerisation for the process of the invention contains resin particles having a particle size of below 1 micrometer, usually of between 0.03 and 0.3 micrometer. This resin emulsion is coagulated in a coagulant containing the second ion required for forming the water-insoluble quaternary ammonium salt, which ion is a quaternary ammonium ion if the resin emulsion contains the anion, and is an anion if the resin emulsion contains the quaternary ammonium ion. The quaternary ammonium ion, or the anion, may be derived from the quaternary ammonium bases, or the organic acids, already mentioned above. The substance supplying the second ion is brought into the coagulant in the form of a salt that is soluble in this medium.

The liquid of the coagulant may be an aqueous electrolyte solution, a mixture of water with one or more water-miscible organic solvents, or merely a water-miscible organic solvent. Preferably, the organic solvent is a water-miscible alcohol, such as ethanol.

Of course, both the coagulant and the ions forming the quaternary ammonium salt in the resin emulsion are so chosen that the quaternary ammonium salt formed during the coagulation of the emulsion will be a salt having a solubility of less than 3% and preferably less than 1% by weight in water at 25° C. Preferably, the substances furnishing the ions needed for forming the water-insoluble quaternary ammonium salt are present in the resin emulsion and the coagulant in stoichiometric quantities and in a concentration that is appropriate for incorporating the desired quantity of water-insoluble quaternary ammonium salt in the coagulated resin particles.

The process according to the invention can be carried out with the coagulation conditions so selected that the resin in the emulsion will coagulate into particles of which the particle size mainly is in the range preferred for the particle size of one-component developer powders, namely between approximately 10 and 45 micrometers. In such a case, the one-component developer powder according to the invention can be obtained simply by separating the particles from the coagulant, drying them and sieving out of the powder any small amount of particles which are too fine or too coarse. The particle size of the coagulated particles can be influenced, for instance, by varying the composition or the temperature of the coagulant, or by varying the rate of addition of the resin emulsion or the intensity of stirring the coagulant.

The incorporation of finely divided additives, such as magnetically attractable material and carbon black, into the developer powder particles according to the invention can be effected by dispersing the additives in the coagulant. This method for incorporating fine solid particles in thermoplastic resin particles is advantageous not only for preparing one-component developer powder according to the invention but also for preparing all other kinds of powders composed of resin particles in which fine solid particles are dispersed, for example for preparing toner powders for so-called binary powder developers or developer powders for magnetographic reproduction systems. Such powders have been prepared heretofore in a rather circuitous manner, by melting thermoplastic resin, dispersing the fine solid particles such as pigment, polarity control agent or magnetically attractable material in the melt and, after cooling the melt, grinding the mass to fine particles, or, by spray drying a dispersion of the fine solid particles in a solution or dispersion of the resin. According to the process of the present invention, such powders are prepared simply by coagulating an emulsion of the resin in a dispersion of the fine solid particles in a coagulant, in which case the coagulant need not contain an ion for forming a water-insoluble quaternary ammonium salt with the anion or cation of the emulsifier in the resin emulsion.

The values of specific resistance of developer powders as referred to herein are measured according to the first method described in Example I of Dutch Patent Application 7203523.

The invention will be further understood from the following illustrative examples of practices of the invention.

EXAMPLE 1

Under stirring, and while nitrogen is passed through, a solution of 180 g of sodium oleate in
5 l of demineralized water is heated to 70° C. While nitrogen is passed through continuously, the solution is stirred at this temperature for 30 minutes, after which 980 g of styrene,
420 g of butyl methacrylate and
42 g of dodecyl mercaptan are added. Subsequently, a solution of 80 g of potassium persulphate in
1,500 ml of demineralized water is added to the mixture, after which the reaction mixture, while nitrogen is passed through continuously, is further stirred at 70° C. for 5 hours. The reaction mixture is then cooled down to room temperature and filtered by passing it through a coarse filter paper.

Under vigorous stirring, 500 ml of the resin emulsion thus obtained are added dropwise at room temperature to a coagulant mixture consisting of:

75 g of magnetically attractable iron oxide having a particle size of about 500 manometers,
6 g of carbon having a particle size between 25 and 100 nanometers,
20 g of an aqueous 40% polypiperidinium chloride solution,
325 ml of ethanol and
325 ml of demineralized water. After all the resin emulsion has been added, the mixture is stirred for 1 more hour at 45° C., then heated to 60° C. and, subsequently, cooled rapidly to room temperature.

The coagulated resin particles are separated from the coagulant and dried to the air. Finally, the particles that have a particle size of between 10 and 45 micrometers are separated by sieving them out of the powder. A black-looking, magnetically attractable one-component developer powder containing approximately 10% by weight of polypiperidinium oleate and having a specific resistance of $1.7\times10^9$ ohm. cm is obtained.

The developer powder is used successfully for developing electrostatic images produced in an electrophotographic copying apparatus as described in relation to FIG. 21 in Dutch patent application 7214704. The copying apparatus is fitted with a photoconductive belt as the imaging medium, which comprises a carrier of polyester film coated on both sides with an electrically conductive layer composed of cellulose-acetate butyrate and carbon in the weight ratio of 1:4, and having one side overcoated with a photoconductive layer containing 7 parts by weight of pink zinc oxide and 1 part by weight of a mixture of polyvinyl acetate with a copolymer of ethyl acrylate and styrene (E202 resin, from De Soto Chemical Company).

EXAMPLE 2

Under vigorous stirring, 400 ml of resin emulsion prepared according to Example 1 is added dropwise at room temperature to a coagulant consisting of
16 g of benzylhexadecyldimethylammonium chloride,
6 g of carbon having particle sizes of between 25 and 100 nanometers and
750 ml of demineralized water.

After the resin emulsion has been added completely, the coagulation mixture is stirred for 1 more hour at 55° C. and, subsequently, is cooled rapidly to room temperature. The coagulated resin particles are separated from the liquid and dried to the air. Finally, the particles that have a particle size of between 10 and 45 micrometers are separated by sieving them out of the dry powder.

A black-looking one-component developer powder having a specific resistance of $2\times10^9$ ohm.cm is thus obtained. This powder also gives good results when it is used in the copying apparatus of Example 1.

EXAMPLE 3

While nitrogen is passed through, a solution of 24.5 g of benzylhexadecyldimethylammonium chloride in
600 ml of demineralized water is stirred for 30 minutes at 70° C. At this temperature, while nitrogen is still passed through, a mixture of 49 g of styrene and
21 g of butyl methacrylate is added to the solution. Then, 4 g of benzoyl peroxide are added to the mixture and, while nitrogen is passed through, the reaction mixture is stirred for 6 hours at 70° C. After cooling to room temperature, the resin emulsion obtained is filtered by passing it through a coarse filter paper.

400 ml of this resin emulsion are then added dropwise at room temperature and with vigorous stirring to a coagulant mixture composed of:

40 g of magnetically attractable iron oxide having a particle size of approximately 500 nanometers,
2.5 g of polyacrylic acid,
1.4 g of sodium hydroxide,
230 ml of ethanol and
340 ml of demineralized water. After all the resin emulsion has been added, the coagulation mixture is stirred for a further 30 minutes at 65° C. and then cooled to room temperature. Finally, the resin particles that have a particle size of between 10 and 45 micrometers are isolated as described above.

The one-component developer powder obtained has a specific resistance of $6\times10^7$ ohm.cm.

EXAMPLE 4

Under vigorous stirring, 400 ml of the resin emulsion prepared according to Example 3 are added dropwise at room temperature to a coagulant mixture composed of:

40 g of magnetically attractable iron oxide having a particle size of approximately 500 nanometers,
8.4 g of p-toluene sulphonic acid sodium salt, 230 ml of ethanol and
490 ml of demineralized water.

After all the resin emulsion has been added, the coagulation mixture is stirred for some time at 60° C. and subsequently is cooled to room temperature. The particles that have a particle size of between 10 and 45 micrometers are then isolated as described above.

The one-component developer powder obtained has a specific resistance of $1.3\times10^{11}$ ohm.cm. An equivalent one-component developer powder is obtained by the use of an equimolar quantity of sodium lauryl sulphate, instead of p-toluene sulphonic acid sodium salt, in the procedure of this example.

EXAMPLE 5

Under stirring, 3 liters of resin emulsion prepared according to Example 1 are added dropwise at room temperature to a coagulant consisting of a solution of:

60 g of polypiperidinium chloride in
3 l of demineralized water.

The coagulated resin particles are separated from the coagulant and dried to the air. Then 350 g of the resulting resin are melted, forming a melt containing approximately 15% by weight of finely divided polypiperidinium oleate, after which
500 g of magnetically attractable iron oxide having a particle size of approximately 500 nanometers and
150 g of carbon having a particle size of between 25 and 100 nanometers are dispersed homogeneously in the melt.

The melt is then cooled to a solid mass and the solid mass is ground to particles having a particle size of between 10 and 40 micrometers.

The one-component developer powder thus obtained has a specific resistance of approximately $3\times10^{6}$ ohm.cm.

The one-component developer powders according to the invention having a specific resistance of between approximately $10^{6}$ and approximately $10^{11}$ ohm.cm can also be obtained with the use of resins other than the styrene butyl acrylate copolymers employed in the above examples. For instance, suitable developer powders according to the invention are also obtained by coagulating in a manner similar to that described in the above examples, in a coagulant in which a quaternary ammonium salt has been dissolved, resin emulsions prepared according to German patent application No. 1,522,650.

What is claimed is:

1. Process for preparing developer powder consisting essentially of particles of thermoplastic resin having dispersed therein, with or without other additive, a substantially water-insoluble quaternary ammonium salt rendering said particles substantially electrically conductive, which process comprises providing an aqueous emulsion of minute thermoplastic resin particles, which emulsion contains in solution an ion that will react with a second ion to form said quaternary ammonium salt, and mixing said emulsion with a coagulant liquid that will coagulate said minute resin particles and contains said second ion in solution, thereby in the resultant mixture forming said minute resin particles into resin coagula of substantially greater size and reacting said ions to form said salt in and substantially uniformly throughout the coagula, said ions being respectively a quaternary ammonium ion and an organic acid anion that forms with said quaternary ammonium ion a quaternary ammonium salt having a solubility of less than 3% by weight in water at 25° C.

2. Process according to claim 1, said coagulant liquid also containing in finely dispersed state as additive an organic dye or fine solid particles, or both; and by said mixing dispersing said additive substantially uniformly throughout said coagula as the coagula are being formed.

3. Process according to claim 1 or 2, the resin particles of said emulsion being of below 1 micrometer in size; and controlling the coagulation conditions so that the resin particles of said emulsion are formed into coagulated particles mainly in the size range of between about 10 and about 45 micrometers.

4. Process for preparing a developer powder consisting essentially of thermoplastic resin particles containing additive material finely dispersed therein and having a specific resistance of between approximately $10^{5}$ and $10^{11}$ ohm.cm, which process comprises forming an aqueous emulsion of minute thermoplastic resin particles by emulsion-polymerization of at least one monomer in an aqueous medium in the presence of an emulsifier that provides in said medium an ion that will react with a second ion to form a substantially water-insoluble quaternary ammonium salt; while stirring vigorously, adding said emulsion gradually to a water-miscible coagulant liquid that will coagulate the emulsion-polymerized resin particles of said emulsion and contains in solution a substance which provides said second ion, thereby coagulating said minute particles into resin coagula of substantially greater size having trapped and uniformly distributed therein fine particles of said quaternary ammonium salt formed in situ by reaction of said ions in the coagulation mixture; and thereafter separating said coagula from the liquid of the coagulation mixture.

5. Process according to claim 4, said at least one monomer comprising styrene and butyl acrylate in quantities whereby the thermoplastic resin formed in said emulsion is a styrene-butyl acrylate copolymer.

6. Process according to claim 4, one of said emulsifier and said substance being a water-soluble quaternary ammonium salt and the other of them being a water-soluble salt of an organic acid having a hydrophobic hydrocarbon group.

7. Process according to claim 4, said emulsion-polymerization being effected so as to form the emulsion-polymerized resin particles with particle sizes below 1 micrometer.

8. Process according to claim 4, said water-miscible liquid being selected from the group consisting of aqueous electrolyte solutions, water-miscible organic solvents and mixtures of water or aqueous electrolyte solutions with water-miscible organic solvents.

9. Process according to claim 4, said emulsifier and said substance being present, respectively, in said aqueous medium and said coagulant liquid, or vice versa, in approximately stoichiometric quantities sufficient to form in said coagula between about 8 and 35% by weight of said quaternary ammonium salt.

10. Process according to claim 5, 6, 7, 8, or 9, said coagulating being effected under conditions whereby said coagula are formed with particle sizes predominantly in the range between about 10 and 45 micrometers.

11. Process according to claim 10, and finally drying said coagula and separating from among the resultant

UNITED STATES PATENT OFFICE

CERTIFICATE OF CORRECTION

Patent No. 4,286,037 Dated August 25, 1981

Inventor(s) ADRIANUS M.P. HECTORS and GERARDUS J.L. CROMMENTUYN

It is certified that error appears in the above-identified patent and that said Letters Patent are hereby corrected as shown below:

Column 2, line 44, in place of "sufficient" read -- suffice --;

Column 3, line 38, "polyalkyltrimethylammonium" should read -- polyallyltrimethylammonium --;

Column 3, line 47, "dialkylammonium" should read -- diallylammonium --;

Signed and Sealed this

*Twenty-sixth* Day of *January 1982*

[SEAL]

*Attest:*

GERALD J. MOSSINGHOFF

*Attesting Officer*

*Commissioner of Patents and Trademarks*